United States Patent [19]

Cockburn et al.

[11] Patent Number: 4,509,468

[45] Date of Patent: Apr. 9, 1985

[54] CYLINDER OILER ASSEMBLY

[75] Inventors: Harrold Cockburn; Darrel Weatherly; Earl Yarbro, all of Bowie, Tex.

[73] Assignee: Bell Manufacturing Company, Bowie, Tex.

[21] Appl. No.: 567,670

[22] Filed: Jan. 3, 1984

[51] Int. Cl.[3] ..... F01M 9/10; F01M 1/00

[52] U.S. Cl. ..... 123/90.38; 123/196 R; 123/195 HC; 184/6.9

[58] Field of Search ..... 123/196 R, 195 C, 198 E, 123/90.38, 90.33, 90.35, 195 HC; 184/6.5, 6.9, 6.8

[56] References Cited

U.S. PATENT DOCUMENTS

| | | | |
|---|---|---|---|
| 1,356,914 | 10/1920 | Fekete | 123/90.38 |
| 1,403,540 | 1/1922 | Church | 123/90.38 |
| 1,543,548 | 6/1925 | Cloyd | 123/90.38 |
| 1,752,055 | 3/1930 | Angle | 123/90.38 |
| 2,366,701 | 1/1945 | Doman | 123/90.35 |
| 2,758,580 | 8/1956 | Balzer | 123/90.38 |
| 2,902,022 | 9/1959 | Bakke et al. | 123/90.38 |
| 3,785,457 | 1/1974 | Strauber | 123/196 R |
| 4,376,425 | 3/1983 | Cantrell | 123/90.38 |

*Primary Examiner*—E. Rollins Cross

*Attorney, Agent, or Firm*—Wofford, Fails & Zobal

[57] ABSTRACT

An improvement in an engine having conventional components including at least one valve, pivotally mounted rocker arm for operating the valve, reciprocally moveable member for effecting pivotal movement of the rocker arm, the improvement being characterized by a cover that is adapted for being sealingly emplaced about the rocker arm and having a plurality of oil inlet apertures to allow oil to be applied to the rocker arm at its points of contact that need lubrication and having at least one oil drain aperture to allow oil to drain therefrom; and oil reservoir for containing the oil, oil drain conduit between the cover and the reservoir, and oil pump having suction connected with the reservoir and a discharge for pumping the oil for lubricating the rocker arm, an oil conduit connected intermediate the pump and the reservoir and the pump and the cover for conveying oil is appropriate and an oil pump power means for powering the oil pump, the oil pump power means being drivingly connected with the oil pump and adapted for pumping oil responsive to reciprocal movement of the reciprocally moveable member of the engine. The details of the oil distribution system, the oil pump power means and the cover are also disclosed.

5 Claims, 8 Drawing Figures

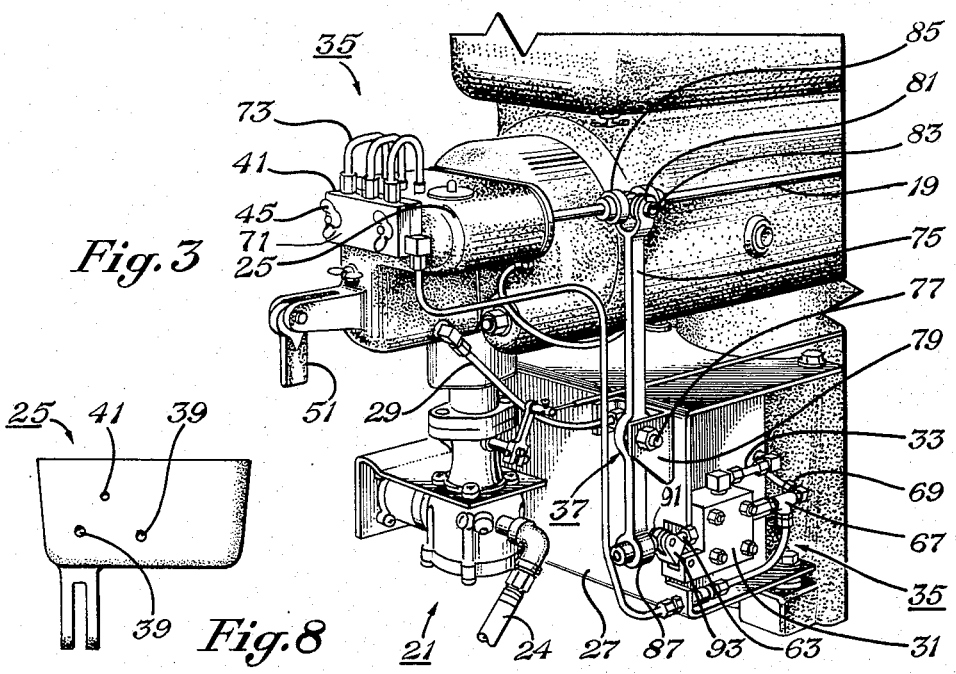
Fig. 3
Fig. 8
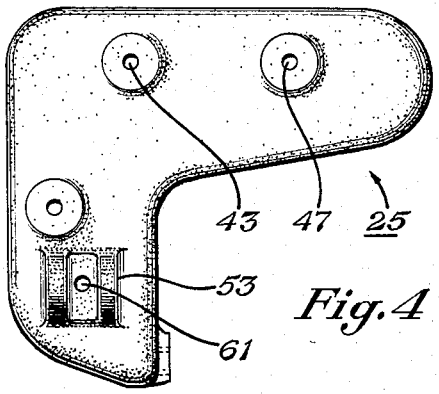
Fig. 4
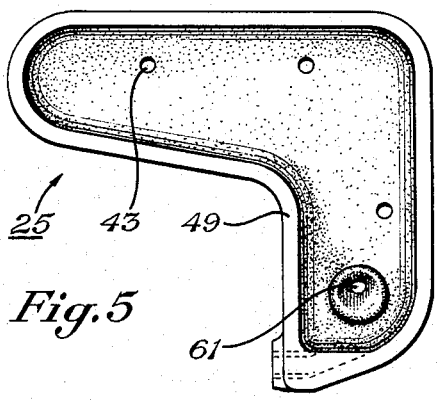
Fig. 5
Fig. 6
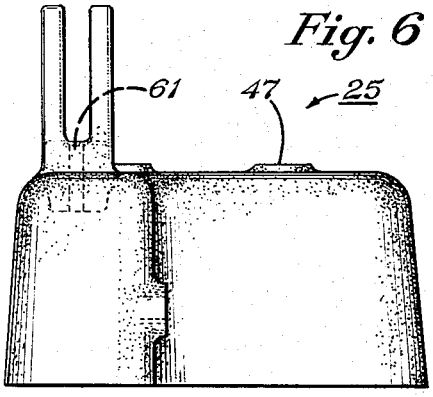
Fig. 7
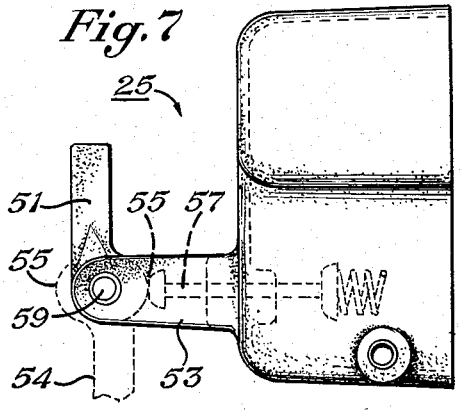

CYLINDER OILER ASSEMBLY

FIELD OF THE INVENTION

This invention relates to accessories for internal combustion engines. More particularly, this invention relates to a cylinder oiler assembly for a simple internal combustion engine such as used at a remote site, like an oil well pumper engine.

DESCRIPTION OF THE PRIOR ART

The prior art has seen the development of a wide variety of different types of motive power, ranging from the early animal powered crude apparatus through internal combustion engine power to modern computer controlled high speed turbines and the like. One of the innovations that has not been satisfactorily replaced was the simple internal combustion engine that could be emplaced at a remote location such as an oil field pumper, pump station, or the like to run with minimal maintenance. One such engine comprised a single cylinder engine with large flywheel capacity to maintain momentum between firing strokes of the engine cycle. In deference to modern technology, manufacturers in the U.S. had stopped making this engine and it was only available from external sources. Because of demand, there has been a resurgence in this country and at least one U.S. company is now making engines and accessories to meet this demand.

One place that the engine is widely employed is in the oil field where pumper servicemen, themselves sometimes referred to as pumpers, would make rounds to lubricate engines at remote sites. The expense of such pumpers has risen dramatically in recent years so ways have been investigated in trying to decrease the frequency of maintenance visits by oilers and to increase the dependability of lubrication and the like. Of course, with modern high speed engines having internal oil distribution systems through lubrication passageways in the crankshaft and the like, this does not present a problem. In the simple type internal combustion engines, however, adequate lubrication has been a problem because of the tendency to use the splash system for internal lubrication. Consequently, no satisfactory external lubrication system for oiling the upper cylinder and associated accessories has been developed.

SUMMARY OF THE INVENTION

Accordingly, it is an object of this invention to provide a simple accessory providing external oiler assembly for oiling the upper cylinder of a simple internal combustion engine.

More specifically, it is an object of this invention to provide a simple external oiler assembly for oiling the upper cylinder assembly and accessories and that is powered by elements of the engine itself, rather than requiring separate electrical power or the like.

These and other objects will become apparent from the descriptive matter hereinafter, particularly when taken into conjunction with the appended drawings.

In accordance with this invention there is provided an improved external lubrication system for an engine having conventional components including at least one valve, pivotally mounted rocker arm for operating the valve, and reciprocally moveable member for effecting the pivotal movement of the rocker arm. The improved lubrication system consists essentially of: (a) a cover for the rocker arm, the cover being sealing emplaced about the rocker arm and having a plurality of oil inlet apertures to allow oil to be applied to the rocker arm at its lubrication points of contact and having at least one oil drain aperture to allow oil to drain therefrom; (b) oil reservoir for containing oil for lubricating the rocker arm; (c) oil drain conduit connected at its one end with the oil drain aperture cover and at its other end with the oil resevoir for recycling oil from the cover to the oil reservoir; (d) oil pump having suction and discharge for pumping the oil for lubricating the rocker arm; (e) oil suction conduit connected respectively with the oil reservoir and the suction of the oil pump so as to convey oil from the reservoir to the pump for being pumped to lubricate the rocker arm; (f) discharge oil distribution system including a plurality of conduits sealingly connected respectively with the discharge of the pump and the plurality of inlet apertures in the cover; and (g) oil pump power means for powering the oil pump, the oil pump power means being drivingly connected so as to operate the pump and driven in response to the engine operation. Details of preferred embodiments are described with respect to the illustrated embodiments and available components.

BRIEF DESCRIPTION OF THE DRAWINGS

FIG. 3 is a partial perspective view of the embodiment of FIG. 2.

FIG. 4 is a outside end view of the cover of the embodiment of FIGS. 2 and 3.

FIG. 5 is an end view from the internal end of the embodiment of FIG. 4.

FIG. 6 a top view of the embodiment of FIG. 4.

FIG. 7 is a partial side elevational view of the embodiment of FIGS. 2 and 3, illustrating in dashed lines and schematically the opening of a valve so as to facilitate starting the engine.

FIG. 8 is a partial top view of the cover of FIGS. 4–7.

DESCRIPTION OF THE PREFERRED EMBODIMENTS

Figure 1:
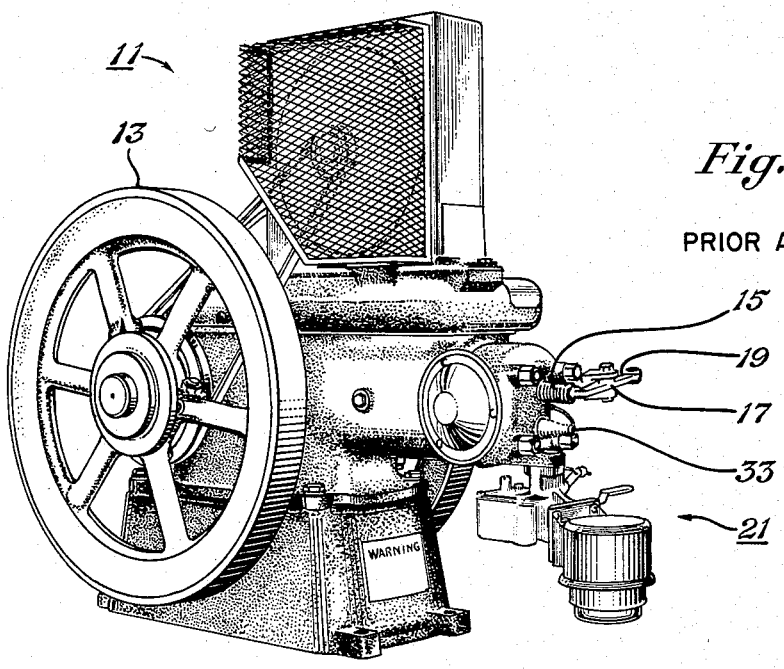
Fig. 1 PRIOR ART
FIG. 1 is an isometric view of a prior art engine on which the embodiment of this invention will be employed.

The invention may be understood by referring to the enclosed drawings. Referring to FIG. 1, the internal combustion engine 11 is illustrated. The engine 11 has an internal cylinder, cylinder head, piston, piston rod, crankshaft connected with a flywheel 13 so as to maintain the reciprocating motion during non-firing portions of the cycle of the engine. The engine 11 is an old type of engine that has been around for many years and need not be described in detail herein. It is noteworthy only in its exceptional reliability and its suitableness for operation for protracted intervals in remote locations. The engine 11 has at least one valve 15, a pivotally mounted rocker arm 17 for operating the valve, a reciprocally moveable member 19 for affecting pivotal movement of the rocker arm to operate the valve. The engine 11 also has conventional carburetion apparatus 21 and firing plugs 23 for intake and combustion internally of the fuel-oxygen mixture. In such engines, any of the conventional fuels such as gasoline or natural gas can be employed as the fuel depending upon the ready availability and relative economics of each fuel. Natural gas fuel and its supply line 24 is illustrated. In any event, it is sufficient to note that the engine will generate power for running pumps, compressors, fans or the like.

As noted hereinbefore, the prior art has not provided a simple, dependable external lubrication system for the engine 11. Ordinarily, such engines employ a simple splash type internal lubrication system which fails to lubricate external components and accessories.

Figure 2:
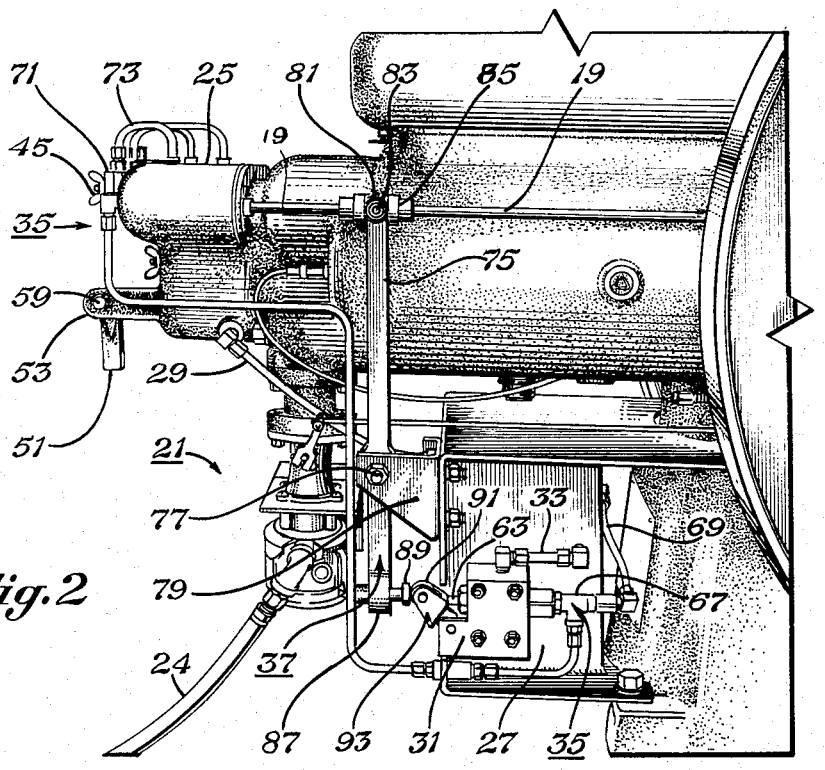
FIG. 2 is a partial side elevational view showing one embodiment of this invention installed on the engine of FIG. 1.

This invention supplies the external lubrication system lacking in the prior art as can be seen in FIGS. 2 and 3. Therein, the lubrication system consists essentially of a cover 25, FIGS. 2–8, an oil reservoir 27, FIGS. 2 and 3, an oil drain conduit 29, an oil pump 31, an oil suction conduit 33, a discharge oil distribution system 35 and an oil pump power means 37.

The cover 25 may take any shape as long as it enabled being sealingly emplaced about the rocker arm and having a plurality of oil inlet apertures located so as to allow oil to be applied to the rocker arm at its points of contact that need lubrication. The cover 25 may also have a plurality of apertures drilled along the longitudinal length to oil springs, valve opening member and their bushings or such other accoutrements as deemed advisable. The cover 25 has at least one oil drain aperture to allow the oil to drain from the cover as it collects, if there is an excess of oil pumped to lubricate the rocker arm. Suitable means are provided for directing oil to lubricate the rocker arm or the like, preferably in the form of oil inlet apertures 39, 41, FIG. 8. Such oil inlet apertures are drilled and tapped to receive threaded bushings or the like for connection with the oil distribution conduit. The oil inlet apertures 39, 41 are adapted to be sealingly connected with a plurality of oil distribution conduits as indicated, and are placed such that they convey the lubricant to the point of lubrication and contact of the rocker arm with valve stems, push rods and the like. As illustrated three such oil inlet apertures are employed, although any number may be employed depending upon the necessity for lubrication.

The cover 25 also has a plurality of bolt holes 43, FIG. 4 that enable it to be fitted onto bolts and be held in place by wing nuts 45, FIG. 2; or to be bolted with stud bolts. As can be seen in FIG. 5, the apertures 43 for the bolts penetrate completely through the cover and have a smooth raised faces 47, FIGS. 4 and 6, to enable the nuts to be screwed into place. The cover 25 has a smooth machined surface 49 about its periphery to sealingly mate with a smooth surface on the cylinder head of the engine on which it will be bolted. Ordinarily, a gasket with or without adhesive is inserted therebetween to facilitate sealing.

While studs can be implanted in the cylinder head, it is frequently advantageous to employ stud bolts and simply have 3 nuts welded to backplate into which the studs are screwed, holding the cover 25 in place.

The cover 25 may be formed of any suitable material having the requisite resistance to distortion under conditions to be found at the remote site; for example, sunlight, rain, snow, wind, dust and the like. Preferably, the cover 25 is formed of cast aluminum such as aluminum 319 and then machined at the appropriate planes and locations to obtain the necessary fits to be sealingly emplaced adjacent a smooth surface on the engine.

As illustrated, the cover has a starting lever 51 that is pivotally mounted in the brackets 53. As can be seen more clearly in FIG. 7, when the starting lever 51 is in the down position as shown by dashed line 53, and as illustrated in FIG. 2, the valve is not depressed and the engine will run normally. The lever has a cam 55, however, that depresses an intermediate member 57 and opens a valve (not shown) that allows the piston to move freely within the cylinder for starting the engine. The flipping up of the start lever 51 releases compression by opening, for example, a suction valve and eases the cranking to get the necessary revolutions per minute for firing. Ordinarily, these engines employ magento firing so cranking speed in revolutions per minute (RPM) must be attained. Expressed otherwise, when the starting lever is moved into the upper position, it opens the valve so that the flywheel can be spun freely to get the desired momentum going and then starting lever flipped down into the starting position for firing the engine. Of course, any other means may be employed for starting the engine as desired. The starting lever 51 is pivotally mounted for pivotal movement about the shaft 59, inserted through apertures in the starting lever and the bracket 54. The shaft 59 may take any of the usual forms such as nut and bolt, bradded shaft or the like. Because of the extra stress that may be involved by movement of the shaft 51 an aperture 61 is provided interiorly of the bracket for insertion of an Allen-head stud for additional attachment to minimize the risk of breaking the cover 25.

Through the use of the cover there is provided a collection means for the oil for returning to the oil reservoir 27.

The oil reservoir 27 may comprise any conventional form. As illustrated, it is a metal reservoir to facilitate attachment of the respective pump means and conduits. Other forms of reservoirs can be employed as long as they have adequate structual strength and resistance to effects of weather and the like. Preferably the reservoir 27 is sealed except for only a small aperture to prevent vacuum. This minimizes contamination from dust, sleet, rain, insects and the like. The reservoir 27 is usually placed lower than the cover such that oil can be drained thereto for recycle through oil drain conduit 29.

Oil drain conduit 29 is connected at one end with the sump of the cover 25 and drains the oil back to the oil reservoir 27. Any of the usual types conduits can be employed as long as they are impervious to the effects of sunlight, weather and the like. The conduits should be impervious to the attack of the oil. As indicated, the oil drain conduit may comprise copper tubing with appropriate fittings. The conventional fittings may be employed to connect into the bottom of the cover 25 and into the top of the oil reservoir 27.

To pump the oil, there is provided oil pump 31. The oil pump 31 may comprise any of the usual types of pump for pumping oil. As illustrated, it is a reciprocating displacement type pump that can pump the desired quantity of oil responsive to very small movements in the plunger and piston interiorly of its cylinder.

The reciprocating pump that is employed employs a small displacement of only about $\frac{3}{8}''$ responsive to push rod movement and must supply sufficient quantity of oil to lubricate the desired accoutrements with this kind of a stroke. Ordinarily the engine will run within a range of about 400 to 675 RPM; for example, in at about 450 RPM; employing the reciprocating member 19 to reciprocate the pump to supply the necessary oil. Consequently, the oil pump that is employed is relatively expensive, although several are commercially available on the market that can be employed to do the job. As can be seen the oil pump 31 has a reciprocally moveable plunger 63, FIGS. 2 and 3 that moves the piston interiorly of its cylinder to pump the oil out through the oil distribution system 35 and employing oil supplied through the oil suction conduit 33.

The oil suction conduit 33 is the conventional copper tubing and fittings, or the like, that connects the oil reservoir 27 with the suction side of the pump 31.

The oil distribution system 35 connected with the discharge of the pump and with the cover 25 and is employed to distribute the pumped oil. As illustrated, the oil distribution system 35 is connected to the pump via a pressure relief valve 67. The downstream side of the pressure relief valve 67 is connected back to the reservoir by a bypass conduit 69 for returning oil in case the oil distribution system becomes plugged and pressure builds up too high. Otherwise the oil distribution system 35 is copper tubing or the like with appropriate fittings and manifolds 71, FIGS. 2 and 3, for supplying a plurality of conduits 73 for conducting the oil to the desired aperture for oiling. The fittings employed with both the suction and distribution conduit may comprise the usual type of tubing fittings such as ells, couplings and male and female fittings. This is well within the skill of the art and need not be described in great detail in this already lengthy application. The manifold 71 can be in the form of any desired drilling interiorly of a block that can be held together such as by wing nuts 45. These wing nuts can be the same nuts that hold the cover in place if desired, or they can be separate from the bolts or studs that hold the cover 25 onto the cylinder head of the engine.

In any event, it can be seen that the oil distribution system 35 connects to the discharge side of the pump and with the respective oiling apertures, passageways and the like to deliver the oil being pumped responsive to movement of the oil pump power means 37.

The oil pump power means 37 is preferably in the form of an element that is moved during normal combustion and running of the engine 11. As illustrated, the power pump means includes an oiler rocker arm 75 that is mounted for pivotal movement about the shaft 77 held within apertures in brackets 79. Suitable bearings (not shown) may be employed about the shaft to facilitate pivotal movement of the oiler rocker arm 75 responsive to movement of the reciprocally moveable member 19 on the engine. Expressed otherwise, the oiler rocker arm has its first end 81 held in pivotal engagement with the reciprocally moveable member 9 by way of suitable bearing pins 83, exhaust rod drive knobs 85 and suitable bearings (not shown).

The pivotally mounted oiler rocker arm has its opposite end 87 with its adjustment bolt 89 engaging roller 91 on a pivotally mounted member 93 that operates the plunger 63 and, in turn, the piston interiorly of the oil pump 31. Accordingly, when the engine is running and the reciprocally moveable member 19 is moved back and forth to effectuate opening and closing of the valves by way of the rocker arm 17 for running, it also simultaneously causes operation of the oil pump 31 and the pumping of the oil through the external oil distribution system 35.

In operation, the elements are connected as described hereinbefore and as illustrated in FIGS. 2 and 3. The starting lever 51 may be moved into the upper position and the desired revolutions per minute obtained for starting the engine. The starting lever 51 is flipped downward into the firing position and the magneto causes firing in the engine employing its natural gas fuel to continue to supply power, rotate the flywheels and the like. Simultaneously, the reciprocally moveable member 19 is moved effecting reciprocal pivotal movement of the respective ends of the oiler rocker arm 75, depressing and releasing the plunger 63 effecting reciprocal movement of the piston in the oil pump 31. This causes the oil taken in through the suction conduit 33 to be discharged through the oil distribution system 35 to lubricate the rocker arm and other desirable accessories. The oil is maintained in a clean condition through the use of the cover that is sealingly affixed to the engine and the oil returned via drain conduit 29 to the reservoir 27.

From the foregoing it can be seen that this invention provides a closed system in which synthetic oil can be employed to resist temperature thickening, oxidation and the like. Moreover, there is no heat so there is no breakdown of the oil and it can be used almost indefinitely. The external lubrication system provides an economical, reliable means of directing oil to the point needing oil and for containing and draining the oil back to the reservoir, protecting the oil from dust, rain, snow and the like. Moreover, the cover has beneficial features including the supporting of the starting lever 51, as well as sealingly maintaining the oil in a clean condition.

From the foregoing, it can be seen that this invention accomplishes the objects delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In an engine having conventional components including at least one valve, pivotally mounted rocker arm for operating said valve, reciprocally movable member for effecting pivotal movement of said rocker arm, splash system for internal lubrication of the engine and including an oil sump internally of the engine for containing oil for the splash system, the improvement consisting essentially of an external lubrication system comprising:

a. a cover for said rocker arm; said cover being sealingly emplaced about said rocker arm and having at least one oil inlet aperture to allow oil to be applied to said rocker arm at its lubrication points of contact and having at least one oil drain aperture to allow oil to drain from said cover;

b. oil reservoir for containing oil for lubricating said rocker arm; said oil reservoir being externally mounted and separate from the engine oil sump;

c. oil drain conduit connected at its one end with said oil drain aperture of said cover and at its other end with said oil reservoir for recycling oil from said cover to said oil reservoir;

d. oil pump having a suction and a discharge for pumping said oil for lubricating said rocker arm; said oil pump being mounted exteriorly of said engine and operable independently of the splash internal lubrication system;

e. oil suction conduit connected respectively with said oil reservoir and said suction of said oil pump so as to convey oil from said reservoir to said pump for being pumped to lubricate said rocker arm; said oil suction conduit being mounted exteriorly of said engine;

f. discharge oil distribution system including a plurality of conduits sealingly connected respectively with said discharge of said pump and containing a manifold for distributing the oil in said external lubrication system to a plurality of lubrication points of contact interiorly of said cover; said discharge oil distribution system being mounted exteriorly of said engine; and g. oil pump power means for powering said oil pump; said oil pump power means being drivingly connected with a moving part of said engine so as to operate said pump and driven in response to the engine operation; said oil pump power means being disposed exteriorly of said engine.

2. The engine and lubricating system of claim 1 wherein said oil pump power means comprises an externally and pivotally mounted lever having two ends, connected at one end with a reciprocally moveable member of the engine and at its second end engaging said pump so as to provide motive power therefor responsive to movement of said reciprocally moveable member.

3. The engine and lubricating system of claim 1 wherein said oil drain conduit comprises copper tubing connected respectively at its ends with said oil drain aperture of said cover and said oil reservoir.

4. The engine and lubricating system of claim 1 wherein said discharge oil distribution system comprises a copper tubing connected to the discharger of said pump and to an inlet of a distribution block, said distribution block having a plurality of outlets and having respective copper tubings connected to said outlets and to said inlet apertures of said cover.

5. The engine and lubrication system of claim 1 wherein said lubrication system is a closed system wherein said cover protects said rocker arm and associated pivotal mounting and points of contact from dirt, dust, weather elements and the like and serves to recycle and store clean oil.

* * * * *